US005944545A

United States Patent [19]

Willhelm et al.

[11] Patent Number: 5,944,545

[45] Date of Patent: Aug. 31, 1999

[54] SINGLE PIN COAXIAL INITIATOR, RETAINER AND CONNECTOR AND METHOD OF OPERATION

[75] Inventors: Robert S. Willhelm, Mesa; Robert J. Strang, Scottsdale, both of Ariz.

[73] Assignee: Talley Defense Systems, Inc., Mesa, Ariz.

[21] Appl. No.: 08/920,824

[22] Filed: Aug. 29, 1997

[51] Int. Cl.[6] ..... H01R 29/00

[52] U.S. Cl. ..... 439/188; 102/202.2; 439/944

[58] Field of Search ..... 439/944, 188, 439/509, 34; 102/202.2, 202.9, 530; 280/737, 741

[56] References Cited

U.S. PATENT DOCUMENTS 3,847,463 11/1974 Hayward et al. .
4,621,578 11/1986 Vallieres et al. ..... 102/202.9
5,153,368 10/1992 Fogle, Jr. ..... 102/202.2
5,178,547 1/1993 Bonas et al. ..... 439/34
5,200,574 4/1993 Cunningham et al. ..... 102/530
5,275,575 1/1994 Cahaly et al. ..... 439/188
5,314,345 5/1994 Cahaly et al. ..... 439/188
5,621,183 4/1997 Bailey ..... 102/202.7
5,686,691 11/1997 Hamilton et al. ..... 102/202.5
5,733,135 3/1998 Kennedy et al. ..... 439/188

*Primary Examiner*—Steven L. Stephan
*Assistant Examiner*—Barry M. L. Standig
*Attorney, Agent, or Firm*—Pennie & Edmonds LLP

[57] ABSTRACT

An initiator positioned in a retainer having a single pin and a arcuate conductive ring shaped and positioned so that the ring can be in conductive shunting contact with the pin or separated from the pin by a connector. The connector may be connected to the initiator or to the retainer.

11 Claims, 6 Drawing Sheets

SINGLE PIN COAXIAL INITIATOR, RETAINER AND CONNECTOR AND METHOD OF OPERATION

BACKGROUND OF THE INVENTION

Present inflators for inflating vehicle air restraint members include an initiator with two pins (U.S. Pat. Nos. 5,314,345 and 5,275,575). The two pins are located side by side and have an associated polarity. Some initiators are manufactured in such manner that one of the pins is visibly identifiable as the ground pin. Initiators are then placed in retainers that hold the initiator in the inflator and are placed in a specific orientation relative to the ground pin. The retainer must be aligned with the initiator ground pin.

Further, prior initiators include a shorting clip placed into the retainer for shunting the pins during shipping and handling. The clip provides an orientation feature for the electrical connector when assembled into a steering wheel, dashboard or elsewhere. The entire assembly must be oriented with the inflator mounting flange or retainer to provide specific orientation of the connector when mounted into the airbag module.

SUMMARY OF THE INVENTION

Broadly, the present invention comprises an initiator connectable with an inflator retainer and an inflator connector. The initiator has preferably two arcuate electrical elements and the retainer has an arcuate first mechanical attachment element. The connector has (1) a second mechanical attachment element for mating engagement with the first attachment element of the retainer and the connector farther has (2) arcuate electrical elements for mating with the arcuate electrical elements of the initiator.

After the initiator and the retainer are connected together, the connector is mechanically and electrically connected to the initiator-retainer unit by arcuate connecting elements. The use of such arcuate connecting elements allows the connector to be connected to the initiator-retainer unit in ante radial orientation.

Alternatively,the connector may be connected to the initiator.

DESCRIPTION OF THE PREFERRED EMBODIMENTS

Figure 1:
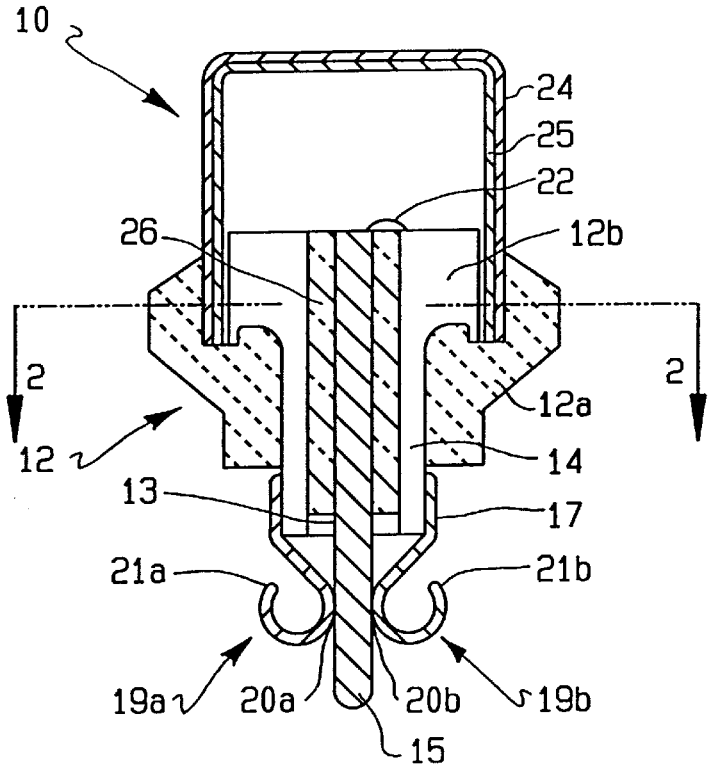
FIG. 1 is an elevational sectional view of the initiator of the present invention.
Figure 2:
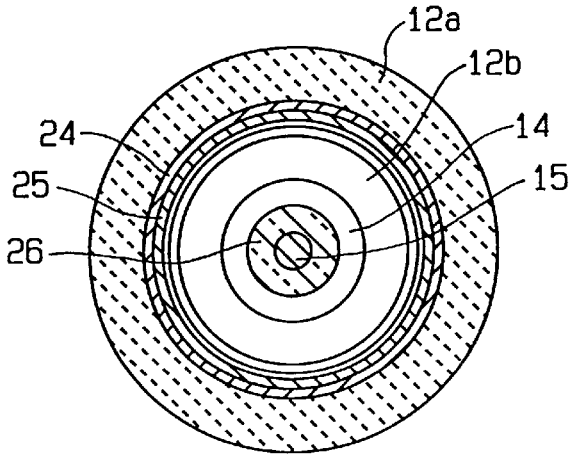
FIG. 2 is a sectional view along line 2—2 of FIG. 1.
Figure 8:
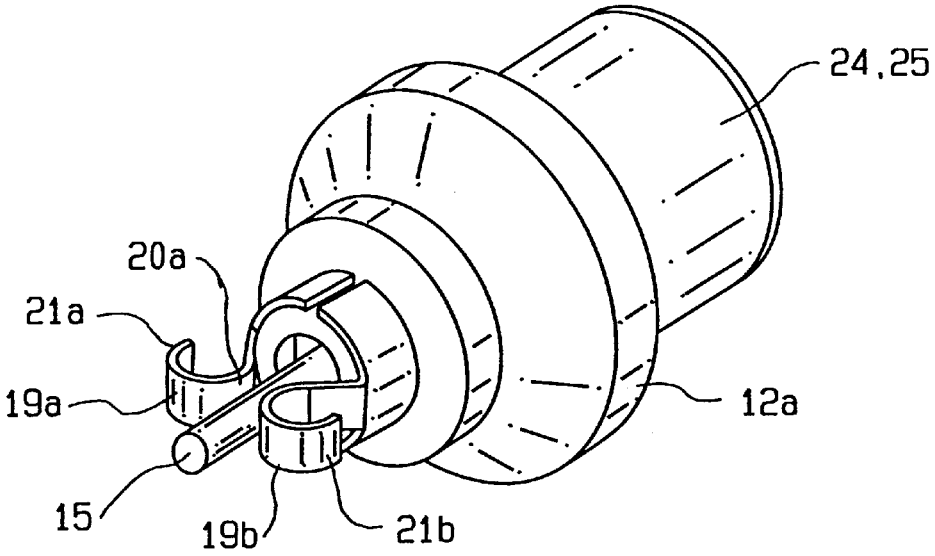
FIG. 8 is a perspective view of the initiator of the present invention.
Figure 9:
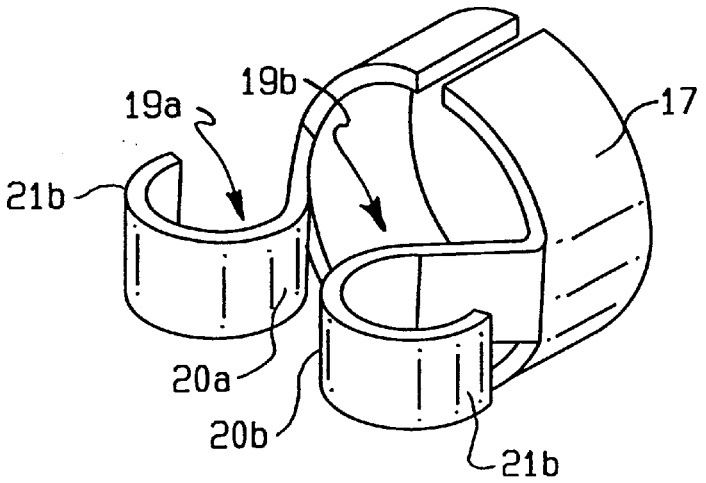
FIG. 9 is a perspective view of the conductive ring and its arms.

In FIGS. 1, 8 and 9, initiator 10 includes header 12, including an outer nonconductive portion 12*a* and an inner conductive portion 12*b* with the lower header portion 12*b* forming collar 14. Initiator 10 further includes pin 15 and a conductive ring 17 with spring-loaded arms 19*a, b* with inner arcuate surfaces 20*a*, 20*b* and outer arcuate surfaces 21*a, b*. While two (2) arms are preferred one arm may be used or three or more arms. Cylindrical pin 15 is positioned in header portion 12*b* central opening 13 and surrounded by glass seal 26. Also shown are bridgewire 22, cups 24, 25 containing pyrotechnic material (not shown).

Figure 3:
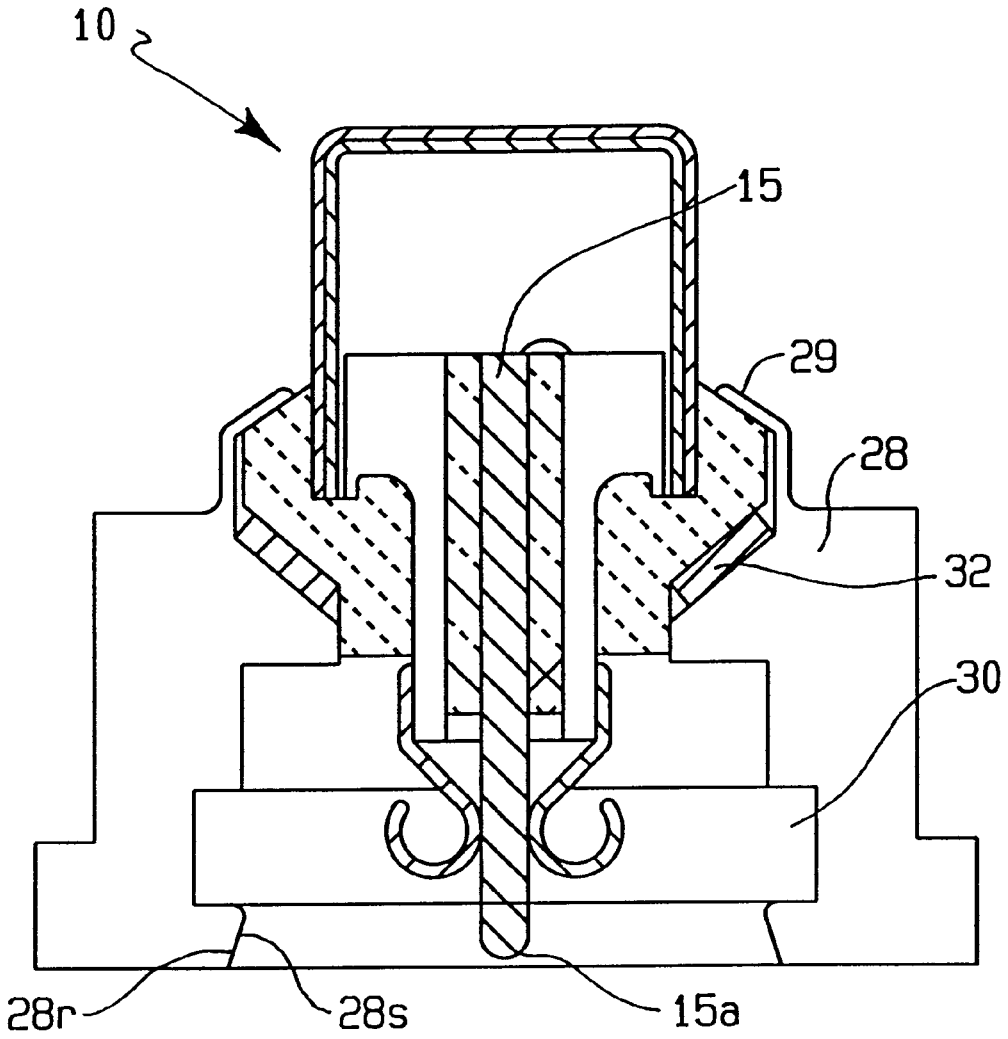
FIG. 3 is an elevational sectional view of the initiator positioned in and secured to a retainer.

Turning to FIG. 3, initiator 10 is mounted in inflator retainer 28 and held by crimped retainer ring 29 against gaskets 32. Retainer 28 may be separate or an integral part of the inflator (not shown). Retainer 28 includes a lower opening 30 surrounding the lower end 15*a* of pin 15. The lowest portion of opening 30 is defined by angled retainer ring 28*r* having ring stop surface 28*s*.

Figure 4:
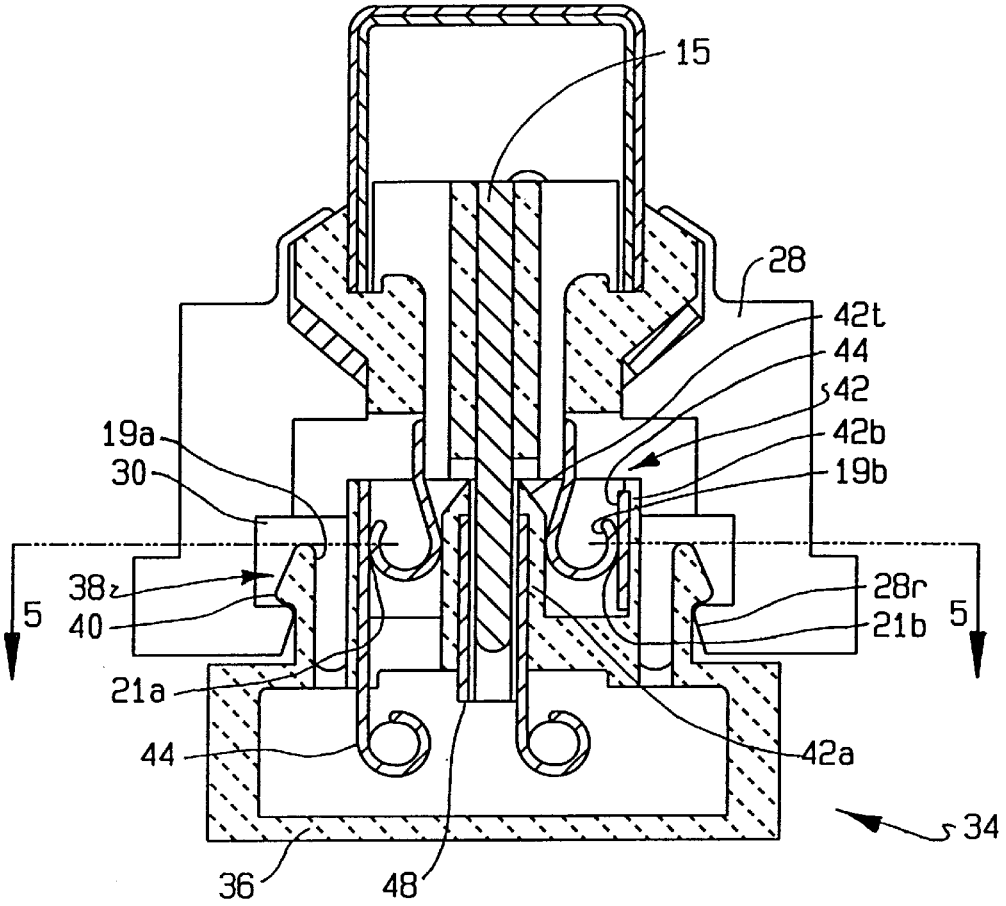
FIG. 4 is an elevational sectional view of the initiator, retainer and connector.
Figure 5:
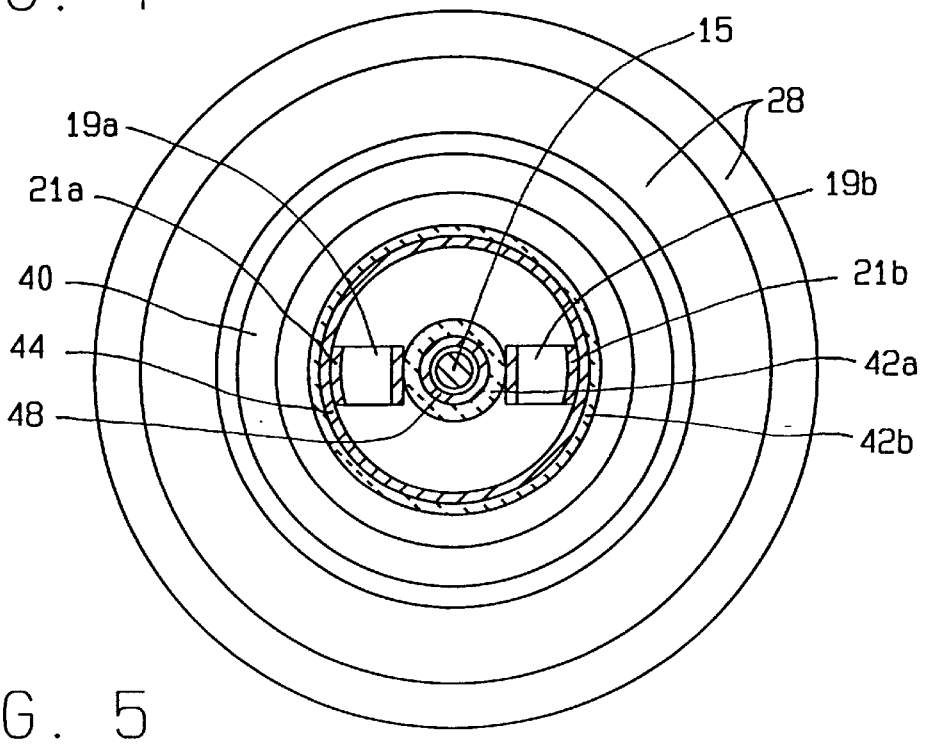
FIG. 5 is a sectional view along line 5—5 of FIG. 4.

With respect to FIGS. 4 and 5, connector 34 is positioned in retainer opening 30 for mechanical engagement with retainer 28 and electrical engagement with initiator 10. Connector 34 includes body portion 36 having deformable ring 38 for snap-engaging lower retainer ring 28*r*. Ledge 40 snaps over ring 28*r* during engagement. Connector 34 also has a central cylindrical core nonconductive portion 42 comprising inner nonconductive cylindrical socket piece 42*a* and outer cylindrical mount piece 42*b* upon which is mounted arcuate electrical terminal contact element 44 which engage the outside surfaces 21*a, b* of arms 19*a, b*. Socket piece 42*a* with tapered end 42*t* functions to move arms 19*a*, 19*b* out of contact with pin 15. Further socket piece 42*a* carries cylindrical terminal 48 for electrical connection to pin 15. Terminal 44*z* is mounted on mount piece 42*b*.

Figure 6:
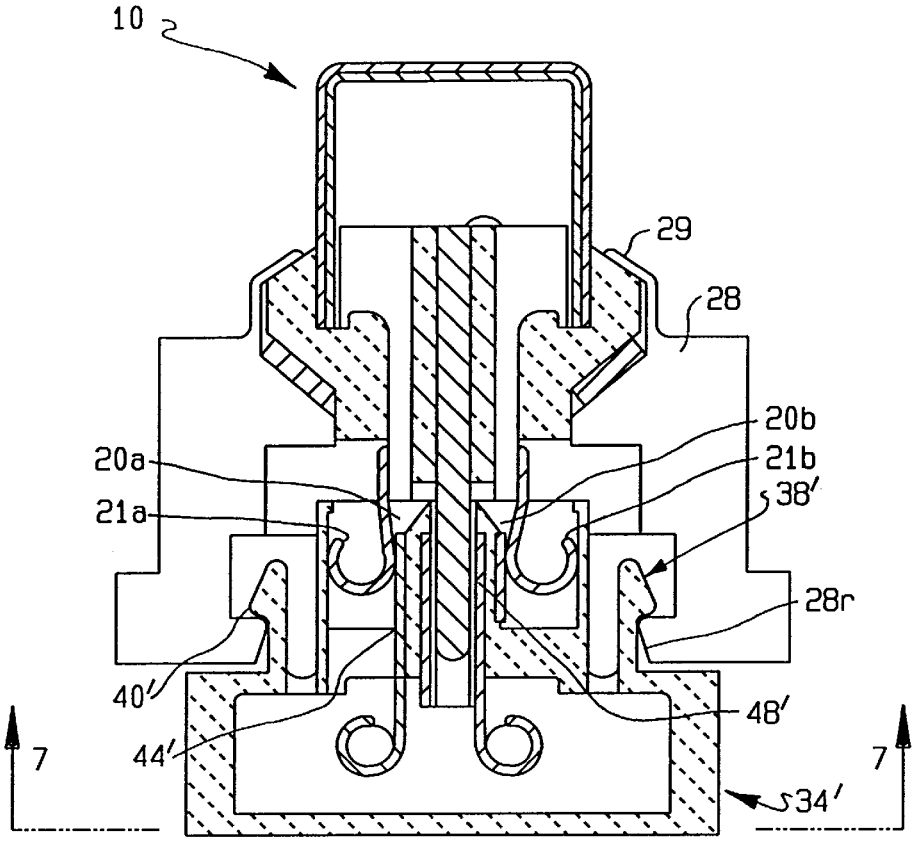
FIG. 6 shows an alternative connector.
Figure 7:
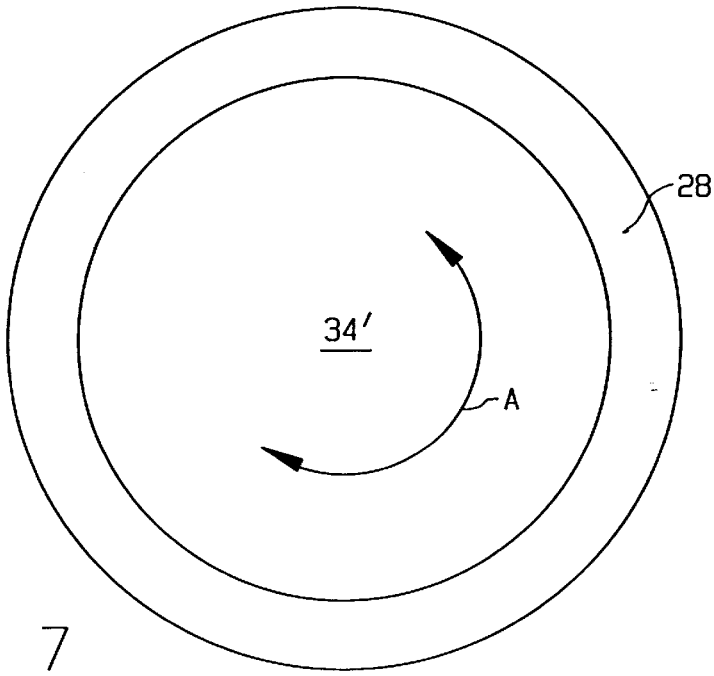
FIG. 7 is a bottom view of the initiator-retainer-connector combination of FIG. 6.

FIG. 6 illustrates an alternative connector 34' in which arcuate contact pieces 44', 48' contact the inside surface 20*a, b* of arms 19*a, b*. In FIG. 7 it is seen that connector 34' can be turned in any radial direction shown by arrow A after mechanical connection to retainer 28 and electrical connection to initiator 10. The reason such turning can be accomplished is that the mechanical connection is between (1) a round, partially round or arcuate ledge 40 of ring 38 and (2) a round, partially round or arcuate ring 28*r*. Likewise, the electrical connections are between cylindrical (arcuate) pin 15; cylindrical (arcuate) terminal 48'; round, partially round terminal 44' and arcuate arm surfaces 20*a, b* or 21*a, b* (FIG. 6). Connector 34' is free to turn against small frictional resistance of such the mechanical and electrical engagements. Since connector 34' is capable of such rotation, connector 34' may be connected to retainer 28 in any radial circulation. Connector 34 of FIG. 4 is similarly rotatable and connectable in any radial orientation.

Figure 10:
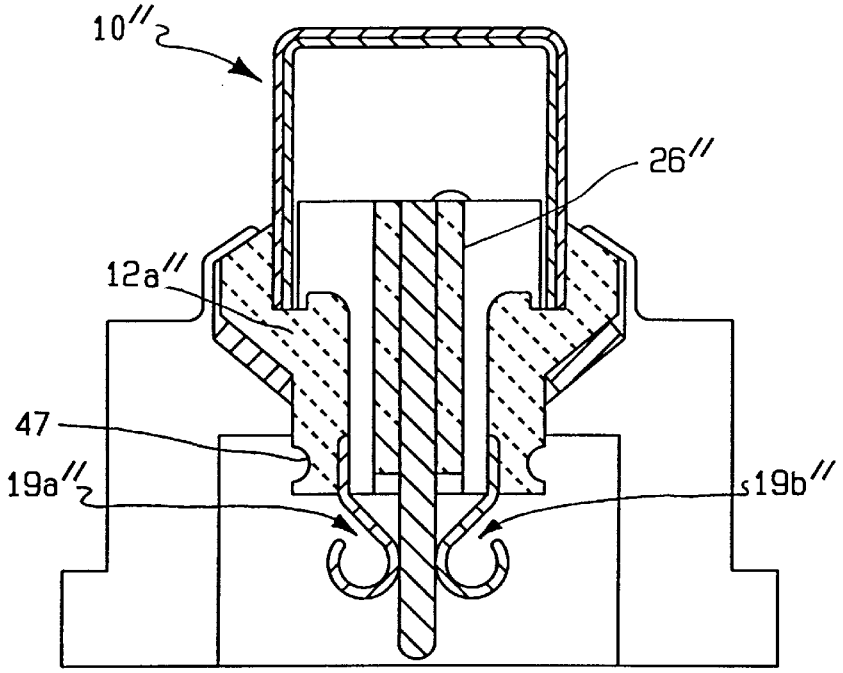
FIG. 10 is an elevational sectional view of another initiator embodiment adapted so that the connector is connectable to the initiator.
Figure 11:
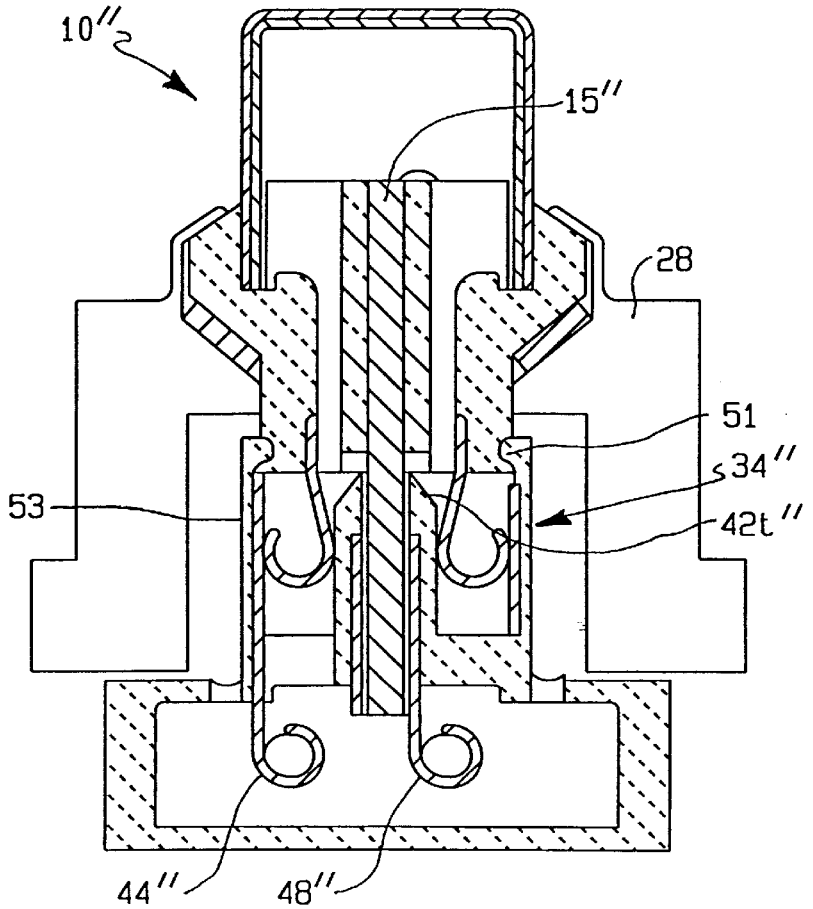
FIG. 11 is a view similar to FIG. 10 with the connector and initiator connected.

Turning to FIGS. 10 and 11, a further embodiment is shown in which the outer nonconductive header portion 12*a*" has a circumferential groove 47 for receiving in snap engagement connector 34" which is similar in construction to the connector 34 of FIG. 4. Connector 34" has cylindrical deformable body portion 53 having at its upper end a cylindrical projection rib 51.

In the operation of the initiator 10, retainer 28 and connector 34, 34' or 34", initiator 10 is inserted into retainer 28 and ring 29 is crimped to urge component 10 against gaskets 32. Next, connector 34, 34' or 34" is placed in any radial orientation and snap fitted into retainer 28 or initiator 10 providing a mechanical connection to retainer 28 or initiator 10 and accomplishing an electrical connection.

We claim:

1. An initiator for an inflator comprising a) a header including a charge and an electrical initiating element capable of initiating such charge;

b) only one electrically conductive pin connected to the electrical initiating element;

c) an arcuate element mounted on the header surrounding such pin and connected to the electrical initiating element;

d) at least one spring-loaded electrically conductive arm connected to such arcuate element and in shunting engagement with such pin; and e) means for separating said at least one electrically conductive spring-loaded arm from said electrically conductive pin to place the pin in a non-shunting mode which means for separating is rotatable about said pin whereby the initiator is protected against inadvertent firing when such arm is in shunting engagement with such pin, and whereby the initiator may be placed in a non-shunting mode.

2. The initiator of claim 1 mounted in a retainer of an inflator.

3. The initiator and retainer combination of claim 2 having in addition a connector mechanically connected to the retainer and electrically connected to said initiator including electrical connection means for connecting to the initiator pin and the initiator arcuate element.

4. The initiator, retainer and connector combination of claim 3 with (a) said connector having a first arcuate mechanical attachment means and having two (2) first arcuate electrical attachment means;

(b) said retainer having a second mechanical arcuate attachment means which is mechanically and frictionally engageable with the first arcuate mechanical attachment means on the connector in any rotational orientation, said mechanical attachment means being so configured that they may be brought together in any rotational orientation to accomplish mechanical attachment and thereafter may be rotated with respect to one another while maintaining such attachment; and (c) said initiator having two (2) second arcuate electrical attachment means mateable with the electrical attachment means of the connector in any rotational orientation, said arcuate electrical attachment means being so configured that they may be brought together in any rotational orientation to accomplish electrical attachment and thereafter may be rotated with respect to one another while maintaining electrical attachment whereby the first and second mechanical arcuate attachment means and the first and second arcuate electrical attachment means are frictionally and rotationally engageable with one another permitting the connector to be connected to the retainer in any rotational orientation and thereafter the connector and the retainer may be rotated with respect to one another while maintaining mechanical attachment and without interrupting electrical attachment between the connector and initiator.

5. The initiator, retainer and connector combination of claim 4 in which the initiator includes a pin and spring-loaded arms and in which the connector includes (a) a nonconductive element for separating at least one spring-loaded arm from engagement with said pin;

(b) one first arcuate electrical attachment means electrically engaged with the pin; and (c) one first arcuate electrical attachment means electrically engaged with one of said arms.

6. The initiator of claim 1 in which the initiator and a connector are connected together.

7. A method of configuring and connecting a connector, initiator and retainer comprising (a) providing first arcuate attachment means on the retainer and second arcuate attachment means compatible with the first attachment means on the connector so that said attachment means are rotatable with respect to one another when attached;

(b) providing first arcuate electrical engagement means on the initiator and second arcuate electrical engagement means on the connector so that said first and second attachment means are rotatable with respect to one another when engaged (c) attaching the first and second arcuate attachment means together at any rotational orientation and thereafter rotating the retainer with respect to the connector; and (d) attaching the first and second electrical engagement means together at any rotational orientation and thereafter rotating the initiator with respect to the connection.

8. A method of connecting a connector, an initiator and a retainer comprising a) providing on the initiator a conductive pin and a spring biased arcuate element surrounding the pin in engagement with the pin as biased;

b) providing on the retainer a first arcuate engagement means and on the connector a second arcuate engagement means where engagement of such engagement means permits relative rotation therebetween;

c) providing nonconductive arcuate insertion means on the connector for insertion between the pin and the pin spring biased arcuate element;

d) attaching the first and second arcuate engagement means together at any rotational orientation and thereafter rotating the retainer with respect to the connector; and e) inserting said insertion means between the pin and the spring-biased arcuate element whereby the connector is mechanically connectable to the retainer and the connector is electrically connected to the initiator in any rotational orientation.

9. An initiator, retainer and connector combination comprising a) means for connecting the initiator to the retainer to form an initiator and retainer member;

b) a detachable connector arrangement for connecting the connector to the initiator and retainer member, such connector arrangement in turn comprising i) a first arcuate mechanical connector means on the connector;

ii) a second arcuate mechanical connector means on the initiator and retainer member;

iii) said first and second mechanical connector means being so configured that they may be brought together in any rotational orientation to accomplish mechanical connection and thereafter may be rotated with respect to one another while maintaining such mechanical connection;

c) an arrangement for electrically connecting the connector to the initiator in turn comprising i) a first arcuate electrical connector means on the initiator;

ii) a second arcuate electrical connector means on the connector;

iii) said first and second electrical connector means being so configured that they may be brought together in any rotational orientation to accomplish electrical connection and thereafter may be rotated with respect to one another while maintaining such electrical connection.

10. An initiator, retainer and connector combination comprising a) first arcuate mechanical and electrical attachment means on the initiator;

b) second arcuate mechanical and electrical attachment means on the connector;

c) said first and second arcuate mechanical and electrical attachment means being so configured that they are engageable together in any rotational orientation to accomplish attachment and thereafter may be rotated with respect to each other while maintaining attachment; and d) means for connecting the initiator to the retainer.

11. A method of connecting a connector, an initiator and a retainer comprising a) providing on a retainer a first arcuate engagement means and on the connector a second arcuate engagement means where upon engagement of such engagement means they are capable of relative rotation therebetween;

b) engaging such first and second arcuate engagement means at any rotational orientation and causing rotation therebetween;

c) providing electrical rotational engagement means for accomplishing electrical engagement between the initiation and the connector; and d) connecting the initiator and connector at any rotational orientation and thereafter rotating the connector and initiator with respect to one another.

* * * * *